US012593953B2

(12) United States Patent
Disch et al.

(10) Patent No.: US 12,593,953 B2
(45) Date of Patent: Apr. 7, 2026

(54) DISHWASHER WITH DIRT DISCHARGE SYSTEM

(71) Applicant: ILLINOIS TOOL WORKS INC., Glenview, IL (US)

(72) Inventors: Harald Disch, Elzach (DE); Martin Schrempp, Biberach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 207 days.

(21) Appl. No.: 18/352,818

(22) Filed: Jul. 14, 2023

(65) Prior Publication Data

US 2024/0016362 A1 Jan. 18, 2024

(30) Foreign Application Priority Data

Jul. 15, 2022 (DE) ..... 10 2022 117 810.2

(51) Int. Cl.

| | |
|---|---|
| ***A47L 15/00*** | (2006.01) |
| ***A47L 15/24*** | (2006.01) |
| ***A47L 15/42*** | (2006.01) |
| ***A47L 15/46*** | (2006.01) |

(52) U.S. Cl.

CPC ..... *A47L 15/4219* (2013.01); *A47L 15/0078* (2013.01); *A47L 15/241* (2013.01); *A47L 15/4202* (2013.01); *A47L 15/4204* (2013.01); *A47L 15/4208* (2013.01); *A47L 15/4225* (2013.01); *A47L 15/4291* (2013.01); *A47L 15/46* (2013.01); *A47L 2401/04* (2013.01); *A47L 2401/10* (2013.01); *A47L 2501/03* (2013.01); *A47L 2501/05* (2013.01)

(58) Field of Classification Search

None

See application file for complete search history.

(56) References Cited

U.S. PATENT DOCUMENTS

| | | | | |
|---|---|---|---|---|
| 2006/0130878 | A1* | 6/2006 | Lee | A47L 15/4225 134/104.4 |
| 2008/0149138 | A1 | 6/2008 | Classen et al. | |
| 2011/0197934 | A1 | 8/2011 | Fueglein et al. | |

FOREIGN PATENT DOCUMENTS

| | | | |
|---|---|---|---|
| CN | 113940601 | A | 1/2022 |
| DE | 6604839 | U | 3/1970 |
| DE | 3723721 | C2 | 8/1998 |
| DE | 102005008987 | B3 | 6/2006 |
| DE | 102005058250 | A1 | 7/2006 |
| DE | 102011084917 | A1 | 4/2013 |
| EP | 121513 | A1 | 10/1984 |
| EP | 378980 | B1 | 10/1993 |
| EP | 1256308 | B1 | 8/2004 |
| EP | 1835840 | B1 | 7/2009 |

(Continued)

*Primary Examiner* — Levon J Shahinian

(74) *Attorney, Agent, or Firm* — THOMPSON HINE LLP

(57) ABSTRACT

A dishwasher includes a washing system configured as a recirculation loop and a dirt discharge system associated with the washing system. The dirt discharge system is associated with a separator apparatus configured so as to separate at least a portion of the washing liquid required to empty a dirt collection region of the dirt discharge system and discharged together with the dirt particles from the dirt collection region from the dirt particles discharged from the dirt collection region and to return the separated washing liquid back to the water circulation of the dishwasher.

15 Claims, 2 Drawing Sheets

(56) References Cited

FOREIGN PATENT DOCUMENTS

| | | | |
|---|---|---|---|
| EP | 2759245 | B1 | 8/2016 |
| EP | 3545813 | A1 | 10/2019 |
| EP | 3366186 | B1 | 3/2022 |

* cited by examiner

DISHWASHER WITH DIRT DISCHARGE SYSTEM

TECHNICAL FIELD

The invention relates typically to the field of industrial washing and, in particular, to a commercial tableware or utensil washer, which is configured as a box-type dishwasher or as a conveyor dishwasher.

BACKGROUND

The invention is thus aimed at a dishwasher having at least one washing zone configured as a recirculation loop. The washing zone configured as the recirculation loop comprises a nozzle system having at least one washing nozzle for spraying washing liquid onto the items to be cleaned, a washing tank for collecting at least a portion of the sprayed washing liquid, and a washing pump for feeding washing liquid collected in the washing tank to the at least one washing nozzle. Furthermore, the dishwasher comprises a dirt discharge system associated with the at least one washing zone, having at least one tank cover screen in order to separate dirt particles from the washing liquid flowing back into the washing tank due to gravity.

Box-type dishwashers are manually loadable and unloadable dishwashers. The box-type dishwashers (also referred to as "batch dishwashers") can be tableware basket sliding dishwashers ("hood-type dishwashers") or front loaders ("front loader dishwashers"). Front loaders can be under-counter machines, top-counter machines, or free-standing front loaders.

A dishwasher configured as a box-type dishwasher typically comprises a treatment chamber for the cleaning of items. Typically, a washing tank is arranged below the treatment chamber, in which liquid can flow back from the treatment chamber due to gravity. In the washing tank, there is washing liquid, which is typically water, to which a cleaning agent may be added.

A dishwasher configured as a box-type dishwasher further comprises a washing system having a washing pump, a conduit system connected to the washing pump, and a nozzle system having at least one washing nozzle. The washing liquid located in the washing tank can be conveyed from the washing pump via the conduit system to the at least one washing nozzle and, through at least one washing nozzle, sprayed onto the items to be cleaned in the treatment chamber. The sprayed washing liquid subsequently flows back into the washer tank due to gravity.

Conveyor dishwashers are in particular flight-type dishwashers or rack conveyor dishwashers. Conveyor dishwashers are commonly used in the commercial sector. By contrast to box-type dishwashers, in which the items to be cleaned remain stationary in the machine during cleaning, in conveyor dishwashers the items to be washed are conveyed through different treatment zones of the conveyor dishwasher.

A conveyor dishwasher typically comprises at least one pre-washing zone and at least one main washing zone located downstream of the pre-washing zone(s) when viewed in the conveying direction of the items to be washed. When viewed in the conveying direction, at least one post-washing or pre-rinsing zone and at least one rinsing zone downstream of the post-washing zone(s) are typically arranged downstream of the main washing zone(s). When viewed in the conveying direction, the items to be washed received either directly on the conveyor belt or held by racks typically run in the conveying direction through the inlet tunnel, the subsequent pre-washing zone(s), main washing zone(s), post-washing zone(s), rinsing zone(s), a drying zone, and into an outlet path.

The aforementioned washing zones of the conveyor dishwasher are each associated with a washing system comprising a washing pump and a conduit system (washing conduit system) connected to the washing pump, via which washing liquid is fed to the nozzle system or the at least one washing nozzle of the nozzle system. The washing liquid fed to the at least one washing nozzle of the nozzle system is sprayed onto the items to be washed in the respective washing zones of the conveyor dishwasher, which are conveyed by a conveyor apparatus of the conveyor dishwasher through the respective washing zones. Each treatment zone is associated with a tank in which liquid sprayed by the washing nozzles is received and/or in which liquid is provided for the nozzle systems of the respective treatment zones.

In conveyor dishwashers commonly known from the prior art, rinsing liquid in the form of fresh water, which can be pure or can be mixed with further additives such as a rinsing agent, is sprayed via the spray nozzles of the rinsing zone onto the items to be washed. At least a portion of the sprayed rinsing liquid is conveyed from zone to zone in a cascading system counter to the conveying direction of the items to be washed.

The sprayed rinsing liquid is collected in a tank (post-washing tank) of the post-washing zone, from which it is conveyed via the washing pump system of the washing system belonging to the post-washing zone to the spray nozzles (post-washing nozzles) of the post-washing zone. In the post-washing zone, washing liquid is rinsed off of the items to be washed. The resulting liquid flows into the washing tank of the at least one main washing zone, which is upstream of the post-washing zone when viewed in the conveying direction of the items to be washed. Here, a cleaning agent is typically added to the liquid, and then the liquid is sprayed onto the items to be washed by a pumping system belonging to the washing system of the main washing zone (washing pump) via the nozzles (washing nozzles) of the main washing zone. From the washing tank of the main washing zone, the liquid then flows into the pre-washing tank of the pre-washing zone, unless a further main washing zone is provided. The liquid in the pre-washing tank is sprayed onto the items to be washed by a pumping system belonging to the washing system of the pre-washing zone (pre-washing pump) via the pre-washing nozzles of the pre-washing zone, in order to remove coarse impurities from the items to be washed.

Typically, dishwashers are equipped with rinsing pumps that feed the rinsing liquid to be sprayed to the conduit system of the rinsing zone. This in particular ensures a virtually constant volume flow rate of the rinsing liquid in the rinsing zone. However, it is also contemplated to use the on-site conduit pressure, for example the pressure of the fresh water supply, in order to supply the rinsing liquid to the conduit system of the rinsing zone. In the latter case, an actuatable valve can be provided between the conduit system and the spray nozzles of the rinsing zone in order to be able to achieve a temporary or complete interruption of the feeding of rinsing liquid to the spray nozzles.

Regardless of whether a dishwasher is configured as a box-type dishwasher or as a conveyor dishwasher, commercial dishwashers thus typically comprise at least one washing zone configured as a recirculation loop, which comprises a nozzle system having at least one washing nozzle for spraying washing liquid onto the items to be cleaned, a washing tank for collecting at least a portion of the sprayed washing liquid, and a washing pump for feeding liquid collected in the washing tank to the at least one washing nozzle.

Because a washing zone configured as a recirculation loop is used in order to clean the items to be washed, at least a portion of the washing liquid already sprayed in the washing zone is guided in a loop, so that there is a risk that the dirt particles removed from the items to be washed will be exponentially pulverized due to the permanent circulation of the washing liquid and thus will no longer be easily separated from the washing liquid through the use of screening apparatuses, etc. Accordingly, there is a risk that, with a washing zone configured as a recirculation cycle, the dirt load of the washing liquid in the washing zone increases with increasing washing time, so that the risk of resoiling of items to be washed increases, and the overall washing result deteriorates.

This problem occurs in particular in the pre-washing or main washing zones of a dishwasher configured as a conveyor dishwasher. Because, in the case of conveyor dishwashers, the flow direction of the washing liquid used is cascadingly counter to the conveying direction of the items to be cleaned, the dirt concentration of the washing liquid in the at least one pre-washing zone is the greatest compared to the dirt concentration of the washing liquid in the remaining treatment zones, as the most dirt accrues in the pre-washing zone.

On the other hand, it cannot be avoided that, over the runtime of a dishwasher configured as a conveyor dishwasher, a portion of the more soiled washing liquid of the pre-washing zone is "dragged" by the conveyance of the items to be washed into the at least one main washing zone downstream of the pre-washing zone. As a result, the dirt load of the washing liquid in the main washing zone increases, and, consequently, the rinsing result in the main washing zone can also deteriorate.

In order to separate the dirt particles introduced into the dishwasher from the washing liquid used for rinsing the items, it is well known to use screening apparatuses in the form of dirt screening baskets in which the dirt particles introduced into the dishwasher are collected. In the case of dishwashers configured as box-type dishwashers, such a dirt screening basket is typically arranged in the sump of the treatment chamber above the washing tank.

On the other hand, with regard to dishwashers configured as conveyor dishwashers, it is known to equip at least the pre-washing tank associated with the pre-washing zone, and preferably also the main washing tank associated with the at least one main washing zone, with flat screens and dirt screening baskets.

In the operation of the dishwasher configured as a box-type dishwasher or as a conveyor dishwasher, the dirt particles rinsed off of the items to be washed with the aid of the circulating washing water fall onto the flat screens due to gravity. There, the dirt particles are separated from the washing liquid flowing back into the corresponding washing tank. The separated dirt particles are then typically flushed into a dirt screening basket.

One problem with automated dirt discharge systems known from the prior art can be seen in the fact that, for system-related reasons, they only have a limited dirt discharge capacity in terms of time. In the known dirt discharge systems, the amount of washing water required in order to pump the dirt particles out of the dirt collection region of the dirt discharge system is designed for the fresh water rinsing amount of the respective machine type. This is necessary in order to ensure a balanced water budget within the machine. If more washing water were used in order to pump out the dirt than fresh water subsequently fed by the fresh water rinsing of the machine, then the water level in the washing tank would decrease, and the washing process would automatically be switched in the further course.

By contrast, the higher the amount of dirt entering the machine, the more washing water is needed in principle in order to pump the accrued dirt out of the machine as fully as possible and thus achieve the best possible dirt discharge performance.

In light of today's continuous efforts to reduce machine consumption with regard to water, energy, and chemistry, there is a focus on the fresh water rinsing amount, because it significantly determines the total water consumption of commercial dishwashers.

Accordingly, in commercial washing, there are two opposing goals that contradict one another with respect to an ideal process workflow:

On the one hand, a large amount of washing water is required, especially when the dirt level is high in the dishwasher, in order to pump the accrued dirt out of the machine using the automatic dirt discharge system. Depending on the type and amount of dirt, the amount of washing water required in order to pump out the dirt can already be higher in conventional dishwashers known from the prior art than is actually available with the downstream fresh water through the fresh water rinsing. This limits the performance of the dirt discharge system to a certain extent on certain types of machines. The reason for this is that water is no longer available to pump out the dirt, because otherwise the water level in the washing tank would drop too far.

On the other hand, the goal is still to reduce the fresh water rinsing amount even further, which naturally makes the aforementioned problem even worse in the long-term, because, from a certain point, not enough washing water is available in order to pump out the accrued dirt or to reliably operate the automatic dirt discharge system.

Based on this situation, the problem addressed by the invention is thus to further develop a dishwasher of the aforementioned type in such a way that the dirt discharge performance can be optimized without increasing the fresh water amount required for the operation of the dishwasher.

SUMMARY

Accordingly, the invention relates to a dishwasher configured as a box-type dishwasher or as a conveyor dishwasher, comprising a dirt discharge system associated with at least one washing system of the dishwasher. The dirt discharge system comprises a dirt collection region arranged at least regionally in the washing tank of the dishwasher. The dirt collection region serves to collect the dirt particles separated from the washing liquid by means of a tank cover screen.

Furthermore, a dirt discharge system fluidly connected to the dirt collection region having a dirt discharge pipe system is provided, via which the dirt collection region of the dishwasher can be emptied, in particular as needed.

The dishwasher according to the invention is characterized in particular in that the dirt discharge system is associated with a separator apparatus configured so as to separate at least a portion of the washing liquid required to empty a dirt collection region and discharged together with the dirt particles from the dirt collection region from the dirt particles discharged from the dirt collection region and to return the separated washing liquid back to the water circulation of the dishwasher.

With this solution, an automatic dirt discharge system for dishwashers is specified, in which the amount of dirt and water pumped out is independent of the amount of fresh water rinsing amount. In this way, the dirt discharge performance of the dishwasher is optimized, because the dirt collection region of the dirt discharge system can be operated independently of the fresh water fed per unit of time to the water circulation of the dishwasher. On the other hand, by returning the separated washing liquid, it is taken into account that the water consumption of the dishwasher must not be increased.

According to embodiments of the dishwasher according the invention, it is provided that the dirt discharge system with the separator apparatus is configured so as to feed the washing liquid separated from the dirt particles discharged from the dirt collection region back to the washing tank of the washing system of the dishwasher, which is equipped with the automatic dirt discharge system. However, in particular in the case of conveyor dishwashers comprising a plurality of treatment chambers connected in series, it is also contemplated that the washing liquid separated in the separator apparatus will be fed to the washing tank of a different treatment zone.

According to preferred implementations of the dishwasher according the invention, it is provided that the dirt discharge system comprises a dirt discharge pump, whose suction side is fluidly connected or connectable to the dirt collection region and whose pressure side is fluidly connected or connectable to the separator apparatus. In particular, it is contemplated for the dishwasher to comprise a control device, which is configured so as to actuate the dirt discharge pump of the dirt discharge system, in particular independently of a fresh water entry into the water circulation of the dishwasher.

In other words, in the solution according to the invention, the dirt discharge system can in fact always be activated when the level of soiling of the washing liquid has reached a critical value, wherein it is in particular not necessary to pay attention to whether a sufficient amount of fresh water is also again fed to the water circulation of the dishwasher.

In a further development of the last mentioned aspect, it is provided that the dishwasher comprises a sensor system, which is configured so as to detect a level of soiling of the washing liquid preferably in the at least one washing tank of the dishwasher and/or to detect a dirt load of the items to be washed in the dishwasher. In particular, it is provided that the control device is configured so as to actuate the dirt discharge pump of the dirt discharge system depending on the detected level of soiling of the washing liquid and/or depending on the detected dirt load of the items to be washed in the dishwasher.

A suitable sensor system can be, for example, a turbidity sensor that detects the level of soiling of the washing liquid. Alternatively or additionally, however, it is also contemplated to use an optical system, in particular a vision camera system, with which the dirt load is measured or detected directly on the items to be washed.

In particular, it can be provided that the control device can be configured so as to automatically activate the dirt discharge pump of the dirt discharge system when the sensor system detects that the level of soiling of the washing liquid detected has reached a predetermined or determinable value, and/or when an increased dirt load of the items to be treated in the dishwasher is detected by the sensor system. Of course, an optional automatic activation or manual activation of the dirt discharge pump of the dirt discharge system is also contemplated.

According to a preferred implementation of the separator apparatus, it is provided that the separator apparatus comprises a collection container that is fluidly connected or connectable to the dirt discharge system, to which, upon emptying of the dirt collection region, the washing liquid with the dirt particles, which is required in order to empty the dirt collection region, is fed from the dirt collection region.

Preferably, a screen system is associated with the collection container, with which screen at least a portion of the washing liquid required for emptying the dirt collection region and discharged from the dirt collection region together with the dirt particles is separated from the dirt particles discharged from the dirt collection region.

According to a further development of the last mentioned aspect, the separator apparatus is configured so as to preferably automatically discharge from the separator apparatus the dirt particles separated from the washing liquid in the separator apparatus. In this context, for example, it is contemplated to remove the dirt particles from the separator apparatus and in particular from the screen system of the separator apparatus with the aid of a pump, in particular an auger feed pump.

According to further developments of the separator apparatus, it is provided that an overflow system is associated with the collection container of the separator apparatus, which system fluidly connects the collection container with a local drain or with the washing tank of the dishwasher. In this way, redundancy is provided in the event that a return of the separated washing liquid from the separator apparatus to the water circulation of the dishwasher is disrupted or interrupted.

Preferably, the separator apparatus is associated with a waste water pump, which is configured, in particular as needed, so as to feed the washing liquid separated in the separator apparatus back to the water circulation of the dishwasher at predetermined times and/or events or continuously.

In this context, it is contemplated in particular that a sensor system is associated with a sensor system, which is configured so as to detect the amount of washing liquid separated in the separator apparatus.

In this regard, it is contemplated that the separator apparatus is associated with a control device configured so as to actuate the waste water pump depending on the amount of the washing liquid separated from the dirt particles in the separator apparatus.

In particular, it can be appreciated that the waste water pump is cyclically actuated, at least as needed or at predetermined or determinable times or events, in particular such that at least a partial rinsing of the screen system of the separator apparatus (if needed) is achievable.

In a further development of solution according to the invention, in order to achieve an even more efficient separation of dirt, it is provided that the separator apparatus comprises a filter system configured so as to filter the washing liquid separated from the dirt particles in the separator apparatus prior to its return to the water circulation of the dishwasher.

According to a further aspect, it is contemplated that the separator apparatus is associated with a heat exchange system for heat recovery of the washing liquid separated from the dirt particles in the separator apparatus, in particular as needed or continuously. This heat can then be used, for example, to heat the fresh water to be fed to the dishwasher.

With the solution according to the invention, a regular or even continuous dirt discharge during operation of the dishwasher can thus be achieved without needing to extend the runtime of the dishwasher and without needing to increase the fresh water consumption of the dishwasher. This not only reduces the risk of resoiling of the items (because the quality of the washing liquid is optimized due to regular or continuous dirt discharge), but also does not negatively affect the capacity of the dishwasher.

Accordingly, the solution according to the invention allows the dirt particles collected using the dirt collection system in the at least one washing zone of the dishwasher to be continuously and automatically removed from the dishwasher. Such a continuous and automatically performed dirt discharge also relieves the operators of the dishwasher. Moreover, it can be effectively prevented that the recirculation of the washing liquid in the washing zone is affected or blocked by overfilling of the dirt collection region.

BRIEF DESCRIPTION OF THE DRAWINGS

Exemplary embodiments of the solution according to the invention are described in further detail below with reference to the accompanying drawings.

The following are shown in the drawings.

DETAILED DESCRIPTION

Figure 1:
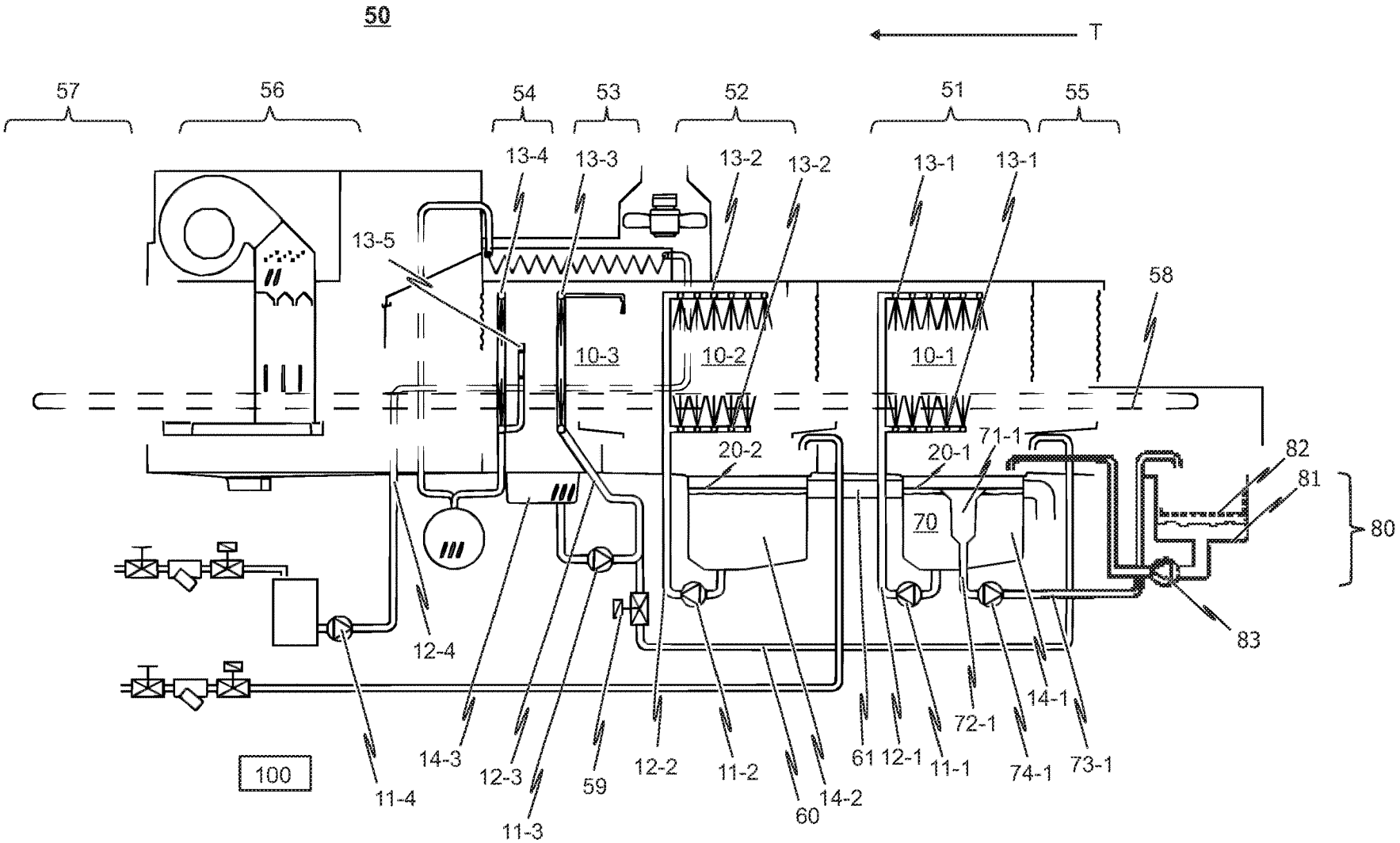
FIG. 1 schematically, a dishwasher configured in the form of a conveyor dishwasher according to a first embodiment of the invention.

In FIG. 1, a schematic longitudinal sectional view shows an example of a conveyor dishwasher 50 configured according to the teachings of the present invention.

The conveyor dishwasher 50 according to the illustration in FIG. 1 comprises a pre-washing zone 51 and a main washing zone 52, which is located downstream of the pre-washing zone 51 when viewed in the conveying direction T of the items to be washed (not shown in FIG. 1). When viewed in the conveying direction T, in the conveyor dishwasher 50 shown in FIG. 1, downstream of the main washing zone 52, a post-washing or pre-rinsing zone 53 and a rinsing zone 54 downstream of the post-washing or pre-rinsing zone 53 are arranged. The items to be washed received either directly on a conveyor belt 58 or held by racks typically run in the conveying direction T through an inlet tunnel 55, the subsequent pre-washing zone 51, the main washing zone 52, post-washing zone 53, the rinsing zone 54, and a drying zone 56 into an outlet path 57.

Spray nozzles 13-1, 13-2, 13-3, 13-4 are respectively associated with the aforementioned treatment zones 51, 52, 53, 54 of the conveyor dishwasher 50, via which nozzles liquid is sprayed onto the items to be washed conveyed by the conveyor belt 58 through the respective treatment zones 51, 52, 53, 54. At least the pre-washing zone 51, the main washing zone 52, and the post-washing or pre-rinsing zone 53 are each associated with a tank (washing tank 14-1, 14-2, 14-3) in which sprayed washing liquid is received and/or washing liquid is provided for the spray nozzles 13-1, 13-2, 13-3 of the relevant zones 51, 52, 53.

The pre-washing zone 51, the main washing zone 52, and the post-washing zone 53 of the conveyor dishwasher 50 according to the first embodiment of the invention shown in FIG. 1 each comprise a washing system 10-1, 10-2, 10-3. Each washing system 10-1, 10-2, 10-3 is comprised of a washing pump 11-1, 11-2, 11-3, a conduit system 12-1, 12-2, 12-3 connected to the washing pump 11-1, 11-2, 11-3, and spray nozzles 13-1, 13-2, 13-3 connected to the conduit system 12-1, 12-2, 12-3.

Furthermore, a control device 100, shown schematically in FIG. 1, is provided, which (among other things) serves to actuate the respective washing pumps 11-1, 11-2, 11-3 of the washing systems 10-1, 10-2, 10-3 appropriately during a washing process, in order to at least temporarily feed washing liquid to the spray nozzles 13-1, 13-2, 13-3 of the nozzle system belonging to the respective washer system 10-1, 10-2, 10-3 via the associated conduit system 12-1, 12-2, 12-3.

In the conveyor dishwasher 50 shown in FIG. 1, rinsing liquid is sprayed onto the items to be washed, not shown in FIG. 1, in the form of fresh water, which can be mixed with further chemical additives such as rinsing agents, via the spray nozzles 13-4 of the rinsing zone 54 arranged above and below the conveyor belt 58. As shown in FIG. 1, laterally arranged spray nozzles 13-5 can also be provided in the rinsing zone 54.

A portion of the rinsing liquid sprayed in the rinsing zone 54 is conveyed from zone to zone in a cascading system counter to the conveying direction T of the items to be washed. The remaining portion is guided directly into the pre-washing tank 14-1 of the pre-washing zone 51 via a valve 59 and a bypass conduit 60.

The rinsing liquid sprayed in the rinsing zone 54 is collected in the tank (post-washing or pre-rinsing tank 14-3) of the post-washing or pre-rinsing zone 53, from which it is conveyed to the spray nozzles 13-3 (post-washing or pre-rinsing nozzles) of the post-washing or pre-rinsing zone 53 via the washing pump 11-3 belonging to the washing system 10-3 of the post-washing or pre-rinsing zone 53. In the post-washing or pre-rinsing zone 53, washing liquid is rinsed off of the items to be washed.

The liquid accumulating here flows into the washing tank 14-2 of the main washing zone 52, and a chemical cleaning agent is typically added, and then the liquid is sprayed onto the items to be washed via the spray nozzles 13-2 (washing nozzles) of the washing system 10-2 belonging to the main washing zone 52 using a washing pump 11-2 belonging to the washing system 10-2 of the main washing zone 52.

From the washing tank 14-2 of the main washing zone 52, the washing liquid then flows into the pre-washing tank 14-1 of the pre-washing zone 51. In the pre-washing zone 51, with the aid of a washing pump 11-1 belonging to the washing system 10-1 of the pre-washing zone 51, the washing liquid collected in the pre-washing tank 14-1 is sprayed on the items to be washed via the spray nozzles 13-1 (pre-washing nozzles) of the washing system 10-1 belonging to the pre-washing zone 51 in order to remove coarse soiling from the items to be washed.

In the conveyor dishwasher 50 shown in FIG. 1, the main washing zone 52 has a tank cover screen 20-2 arranged above the main washing tank 14-2. In the operation of the conveyor dishwasher 50, washing liquid is sprayed onto the items to be washed via spray nozzles 13-2 (washing nozzles) of the washing system 10-2. The sprayed washing liquid returns to the washing tank 14-2 of the main washing zone 52 due to gravity, wherein the dirt particles rinsed off in the main washing zone 52 are retained by the tank cover screen 20-2, provided the dirt particles are larger than the mesh size of the tank cover screen 20-2. The mesh size of the tank cover screen 20-2 is preferably in a range of approximately 1 mm to 4 mm.

In the conveyor dishwasher 50 schematically shown in FIG. 1, in order to clean the tank cover screen 20-2, the rinsing operation must be interrupted for manual cleaning of the tank cover screen 20-2.

A portion of the washing liquid sprayed in the main washing zone 52 enters the washing tank (pre-washing tank 14-1) of the pre-washing zone 51 via an overflow system 61. Like the main washing zone 52, the pre-washing zone 51 is equipped with a tank cover screen 20-1 configured as a flat screen. This tank cover screen 20-1 is arranged above the washing tank (pre-washing tank 14-1) of the pre-washing zone 51 in order to separate dirt particles from the washing liquid sprayed in the pre-washing zone 51 and flowing back into the pre-washing tank 14-1 due to gravity. The mesh size of the tank cover screen 20-1 is preferably in a range between approximately 1 mm and 4 mm.

As explained above, because the dirt concentration of the washing liquid in the pre-washing zone 51 is the greatest due to the fact that the most dirt is accrued here, the conveyor dishwasher 50 shown in FIG. 1 is equipped with a dirt discharge system 70 associated with pre-washing zone 51, which has a dirt collection region 71-1 arranged within pre-washing zone 51, and in particular within the pre-washing tank 14-1.

The construction and operation of the dirt discharge system 70 used in the conveyor dishwasher 50 shown in FIG. 1 will also be described in further detail below with reference to the illustration in FIG. 2.

In the embodiment of the conveyor dishwasher 50 shown in FIG. 1, the dirt collection region 71-1 is used in order to collect the dirt particles separated from the washing liquid using the tank cover screen 20-1.

Specifically, and as will be described in further detail below with reference to the illustration in FIG. 2, the dirt collection region 71-1 is configured as a chamber arranged in the pre-washing tank 14-1, preferably opening upwardly, which can have a pressure equalization system on its sides. Through the upper opening, the dirt particles separated by means of the tank cover screen 20-1 can pass into the chamber-shaped dirt collection region 71-1. Due to the fact that the dirt collection region 71-1 comprises a pressure equalization system on its sides, a particularly rapid emptying of the dirt collection region 71-1 can be realized.

As will be described in further detail below with reference to the illustration in FIG. 2, it is preferred that the tank cover screen 20-1 is arranged above the dirt collection region 71-1 and has a drain slope in the form of a gradient directed towards a feed opening 22, wherein the dirt collection region 71-1, which preferably opens upwards, is arranged below the feed opening 22, such that the dirt particles separated with the aid of the tank cover screen 22 can pass into the dirt collection region 71-1 via the feed opening 22.

Figure 2:
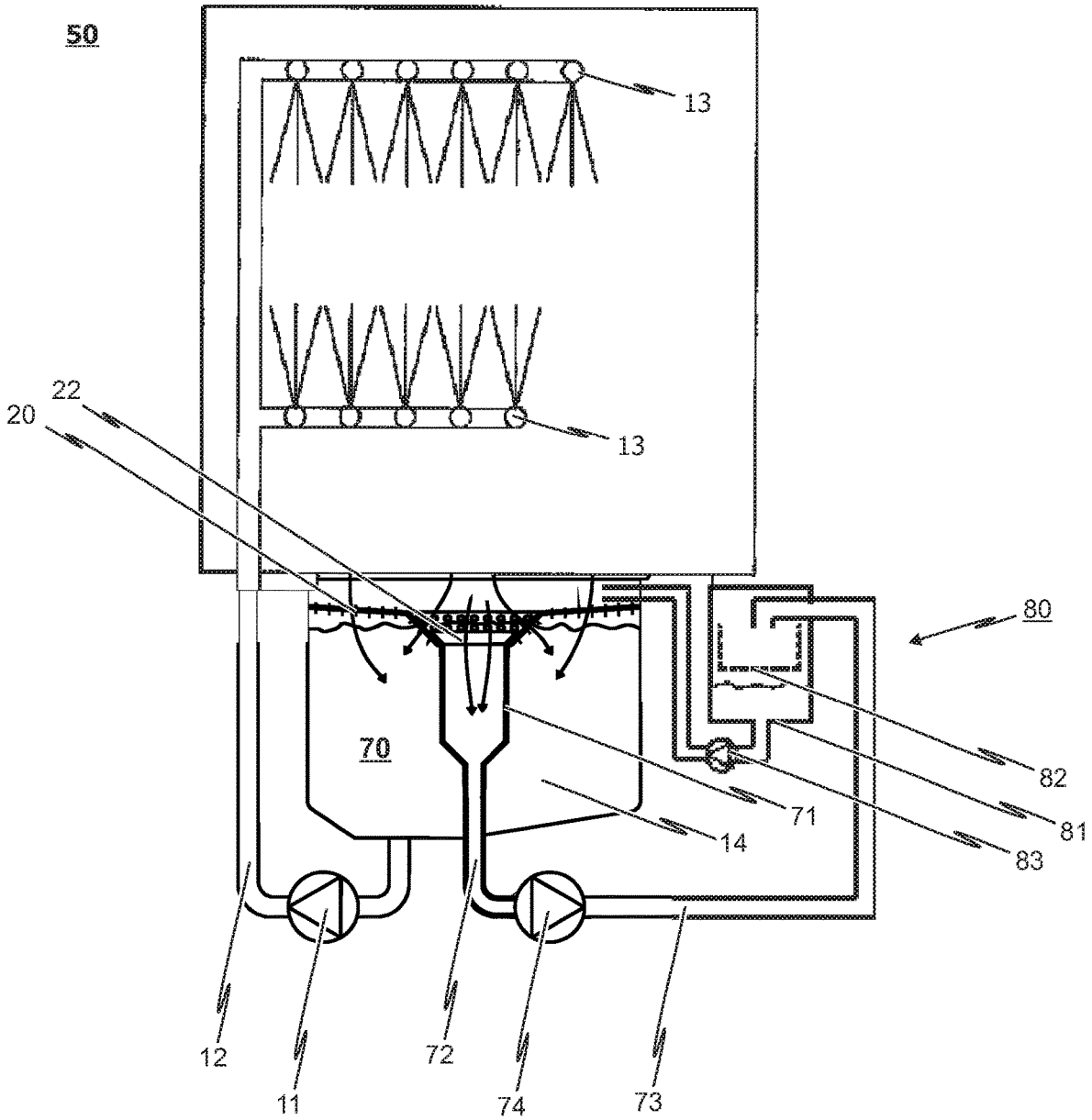
FIG. 2 schematically, a dishwasher configured in the form of a box-type dishwasher according to a second embodiment of the invention.

It is contemplated in particular that the tank cover screen 20-1 is configured in a funnel-like manner, at least regionally, wherein the feed opening 22 is configured within the funnel-like region 21 of the tank cover screen 20-1, and preferably in the zenith of the funnel-like region 21 of the tank cover screen 20-1 (cf. in this regard also in particular the illustration in FIG. 2).

The dirt discharge system 70 used in the embodiment shown in FIG. 1 further comprises a dirt discharge system 70 connected to the dirt collection region 71-1, for example consisting of a standpipe 72-1 and a dirty water conduit 73-1, for discharging the dirt particles collected in the dirt collection region 71-1 from the pre-washing zone 51.

As shown, a dirt discharge pump 74-1 is arranged in the dirt discharge system 70; 72-1, 73-1. The suction-side inlet of the dirt discharge pump 74-1 is connected to the lower region of the dirt collection region 71-1 via the standpipe 72-1 associated with the dirt discharge system 70. The pressure-side outlet of the dirt discharge pump 74-1 opens into the dirty water conduit 73-1 associated with the dirt discharge system 70.

In the embodiment depicted in FIG. 1, the dirty water conduit 73-1 leads to a separator apparatus 80, which can be arranged outside the pre-washing zone 51 upstream of the inlet tunnel 55 of the conveyor dishwasher 50.

The separator apparatus 80 configured so as to separate at least a portion of the washing liquid required to empty a dirt collection region 71-1 and discharged together with the dirt particles from the dirt collection region 71-1 from the dirt particles discharged from the dirt collection region 71-1 and to return the separated washing liquid back to the water circulation of the dishwasher 50.

In the exemplary embodiment of the dishwasher configured as a conveyor dishwasher 50 shown in FIG. 1, it is specifically provided that the washing liquid separated from the dirt particles removed from the dirt collection region 71-1 is fed back to the washing tank 14-1 of the dishwasher 50.

The dirt discharge pump 74-1 is fluidly connected or connectable to the dirt collection region 71-1 on its suction side and fluidly connected or connectable to the separator apparatus 80 on its pressure side.

In particular, the dirt discharge pump 74-1 can be activated independently of a fresh water entry into the water circulation of the dishwasher 50.

According to a contemplated realization, the dishwasher 50 comprises a sensor system, which is configured so as to detect a level of soiling of the washing liquid preferably in the washing tank 14-1 of the dishwasher 50 and/or to detect a dirt load of the items to be washed in the dishwasher 50.

In particular, it is contemplated that the control device is configured so as to actuate the dirt discharge pump 74-1 of the dirt discharge system 70 depending on the detected level of soiling of the washing liquid and/or depending on the detected dirt load of the items to be washed in the dishwasher 50.

In the exemplary embodiment of the dishwasher according the invention 50 shown in FIG. 1, it is contemplated that the separator apparatus 80 comprises a collection container 81 that is fluidly connected or connectable to the dirt discharge system 70, to which, upon emptying of the dirt collection region 71-1, the washing liquid with the dirt particles, which is required in order to empty the dirt collection region 71-1, is fed from the dirt collection region 71-1.

A screen system 82 is associated with the collection container 81, with which screen at least a portion of the washing liquid required for emptying the dirt collection region 71-1 and discharged from the dirt collection region 71-1 together with the dirt particles is separated from the dirt particles discharged from the dirt collection region 71-1.

In particular, the separator apparatus 80 is associated with a waste water pump 83, which is configured, preferably as needed, so as to feed the washing liquid separated in the separator apparatus 80 back to the water circulation of the dishwasher 50 at predetermined times and/or events or continuously.

In FIG. 2, a second exemplary embodiment of the dishwasher 50 according the invention is shown, which is a dishwasher 50 configured as a box-type dishwasher and having a single treatment chamber in which washing liquid is sprayed onto the items to be treated via spray nozzles.

A dirt discharge system 70 is arranged in the washing tank of the dishwasher configured as a box-type dishwasher, as described in principle above with reference to the conveyor dishwasher 50 shown in FIG. 1.

As in the embodiment of the dishwasher 50 according to the invention shown in FIG. 1, a separator apparatus 80 is associated with the automatic dirt discharge system 70.

The dirt discharge system 70 is arranged within the washing tank 14 of the dishwasher 50 configured as a box-type dishwasher. The dirt discharge system 70 comprises a tank cover screen 20, which is preferably arranged in the washing tank 14 above the liquid level of the washing liquid received in the washing tank 14. The tank cover screen 20 serves to separate dirt particles from the washing liquid flowing back into the washing tank due to gravity. For this reason, a suitable mesh size must be provided for the tank cover screen 20.

Furthermore, the dirt discharge system 70 comprises a dirt collection region 71 that is configured as a chamber that opens upwards. Via the opening of the chamber-like dirt collection region 71, the dirt particles separated from the tank cover screen 20 are fed to the dirt collection region 71. For this purpose, it is preferred when the tank cover screen 20 comprises a drain slope in the form of a gradient directed towards a feed opening 22, wherein the dirt collection region 71, which is configured so as to open upwards, is arranged below the feed opening 22.

For example, as shown in FIG. 2, it is contemplated that the tank cover screen is configured in a funnel-like manner, at least regionally, wherein the feed opening 22 is configured within the funnel-like region 21 of the tank cover screen 20, and preferably in the tapered region of the funnel-like region 21 of the tank cover screen 20.

It is further preferred when the dirt collection region 71 is funnel-shaped at the upper end in order to be able to be inserted or received in the feed opening 22 of the tank cover screen 20.

In the operation of the dishwasher 50 (not shown in FIG. 2), the washing zone sprays washing liquid, wherein a portion of the sprayed washing liquid flows back into the washing tank 14 via the tank cover screen 20. The remaining portion of the sprayed washing liquid flows directly into the dirt collection region 71 via the feed opening 22 provided in the tank cover screen 20 due to gravity. The dirt particles rinsed off of the items to be washed during the washing process, provided they are larger than the mesh size of the tank cover screen 20, are prevented by the tank cover screen 20 from entering the washing liquid collected in the washing tank 14. Rather, the dirt particles separated from the tank cover screen 20 are moved through the drain slope to the feed opening 22 and thus enter the dirt collection region 71.

In order to be able to preferably automatically empty the dirt collection region 71, the dirt discharge system 70 preferably further comprises a dirt discharge pipe system. This dirt discharge pipe system, in the embodiment of the dirt discharge system 70 shown in FIG. 2, consists of a standpipe 72 connected to the lower region of the dirt collection region 71. The standpipe 72 is connected to the suction-side inlet of a dirt discharge pump 74. The pressure-side outlet of the dirt discharge pump 74 opens into a dirty water conduit 73 such that, upon activation of the dirt discharge pump 74, the contents of the dirt collection region 71 can be discharged from the washing zone.

The dirt discharge pump 74 is preferably configured so as to remove the dirt particles collected in the dirt collection region 71 together with the washing liquid also collected in the dirt collection region 71, at predetermined times and/or events or continuously. In particular, it is contemplated that the dirt discharge pump 74 will be actuated via the aforementioned control device 100 as a function of the amount of dirt particles collected in the dirt collection region 71.

Nevertheless, it is of course contemplated that the pumping of dirt out of the dirt collection region 71 can occur as a function of, for example, the level in the dirt collection region 71, the level in the washing tank 14, or other factors.

In the embodiment shown in FIG. 2, the dirty water conduit 73 leads to a separator apparatus 80. The separator apparatus 80 configured so as to separate at least a portion of the washing liquid required to empty a dirt collection region 71 and discharged together with the dirt particles from the dirt collection region 71 from the dirt particles discharged from the dirt collection region 71 and to return the separated washing liquid back to the water circulation of the dishwasher 50.

The invention is not limited to the embodiments described in connection with the drawings.

The invention claimed is:

1. A dishwasher having at least one washing system configured as a recirculation loop, wherein the at least one washing system comprises a nozzle system having at least one washing nozzle for spraying washing liquid onto items to be cleaned, a washing tank for collecting at least a portion of the sprayed washing liquid, and a washing pump for feeding washing liquid collected in the washing tank to the at least one washing nozzle, and wherein a dirt discharge system associated with the at least one washing system is provided, wherein a tank cover screen is associated with the dirt discharge system, which screen is configured so as to separate dirt particles from the sprayed washing liquid that flows back into the washing tank due to gravity, wherein the dirt discharge system comprises a dirt collection region arranged at least regionally in the washing tank for collecting the dirt particles separated from the washing liquid by the tank cover screen, and wherein the dirt discharge system is fluidly connected to the dirt collection region, via which the dirt collection region can be emptied, wherein the dirt discharge system is associated with a separator apparatus configured so as to separate at least a portion of the washing liquid required to empty the dirt collection region and discharged together with the dirt particles from the dirt collection region from the dirt particles discharged from the dirt collection region and to return the separated washing liquid back to the water circulation of the dishwasher;

wherein the dirt discharge system comprises a dirt discharge pump, whose suction side is fluidly connected or connectable to the dirt collection region and whose pressure side is fluidly connected or connectable to the separator apparatus, wherein the dishwasher comprises a control device, which is configured so as to actuate the dirt discharge pump of the dirt discharge system independently of a fresh water entry into the water circulation of the dishwasher.

2. The dishwasher according to claim 1, wherein the dirt discharge system with the separator apparatus is configured so as to feed the washing liquid separated from the dirt particles discharged from the dirt collection region back to the washing tank of the dishwasher.

3. The dishwasher according to claim 1, wherein the dishwasher comprises a sensor system, which is configured so as to detect a level of soiling of the washing liquid in the at least one washing tank of the dishwasher and/or to detect a dirty loading of the items to be washed in the dishwasher, wherein the control device is configured so as to actuate the dirt discharge pump of the dirt discharge system depending on the detected level of soiling of the washing liquid and/or depending on the detected dirty loading of the items to be washed in the dishwasher.

4. The dishwasher according to claim 1, wherein the separator apparatus comprises a collection container that is fluidly connected or connectable to the dirt discharge system, to which, upon emptying of the dirt collection region, the washing liquid with the dirt particles, which is required in order to empty the dirt collection region, is fed by the dirt discharge pump from the dirt collection region, wherein a screen system is associated with the collection container, with which screen at least a portion of the washing liquid required for emptying the dirt collection region and discharged from the dirt collection region together with the dirt particles is separated from the dirt particles discharged from the dirt collection region.

5. The dishwasher according to claim 4, wherein the separator apparatus is configured so as to automatically discharge from the separator apparatus the dirt particles separated from the washing liquid in the separator apparatus.

6. The dishwasher according to claim 5, wherein the control device is configured so as to cyclically actuate the waste water pump at predetermined or determinable times or events, such that at least partial rinsing of the screen system of the separator apparatus is achievable.

7. The dishwasher according to claim 4, wherein an overflow system is associated with the collection container of the separator apparatus, which overflow system fluidly connects the collection container with a local drain or with the washing tank of the dishwasher.

8. The dishwasher according to claim 1, wherein the separator apparatus is associated with a waste water pump, which is configured so as to feed the washing liquid separated in the separator apparatus back to the water circulation of the dishwasher at predetermined times and/or events or continuously.

9. The dishwasher according to claim 8, wherein the separator apparatus is associated with a sensor system configured so as to detect the amount of washing liquid separated in the separator apparatus, and wherein the separator apparatus is associated with a control device configured so as to actuate the waste water pump depending on the amount of the washing liquid separated from the dirt particles in the separator apparatus.

10. The dishwasher according to claim 1, wherein the separator apparatus comprises a filter system configured so as to filter the washing liquid separated from the dirt particles in the separator apparatus prior to its return to the water circulation of the dishwasher.

11. The dishwasher according to claim 1, wherein the separator apparatus is associated with a heat exchange system for heat recovery of the washing liquid separated from the dirt particles in the separator apparatus.

12. The dishwasher according to claim 1, wherein the dishwasher is configured as a conveyor dishwasher, wherein the at least one washing system is configured as at least one washing zone, and wherein, in addition to the at least one washing system configured as a washing zone, the conveyor dishwasher comprises at least one rinsing zone as well as a conveyor device for conveying the items to be washed through the at least one washing system configured as a washing zone and the at least one rinsing zone that is downstream of the washing system when viewed in the conveying direction of the items to be washed; or wherein the dishwasher is configured as a program automation and comprises a treatment chamber in which the washing system is configured.

13. A dishwasher having at least one washing system configured as a recirculation loop, wherein the at least one washing system comprises a nozzle system having at least one washing nozzle for spraying washing liquid onto items to be cleaned, a washing tank for collecting at least a portion of the sprayed washing liquid, and a washing pump for feeding washing liquid collected in the washing tank to the at least one washing nozzle, and wherein a dirt discharge system associated with the at least one washing system is provided, wherein a tank cover screen is associated with the dirt discharge system, which screen is configured so as to separate dirt particles from the sprayed washing liquid that flows back into the washing tank due to gravity, wherein the dirt discharge system comprises a dirt collection region arranged at least regionally in the washing tank for collecting the dirt particles separated from the washing liquid by the tank cover screen, and wherein the dirt discharge system is fluidly connected to the dirt collection region, via which the dirt collection region can be emptied, wherein the dirt discharge system is associated with a separator apparatus configured so as to separate at least a portion of the washing liquid required to empty the dirt collection region and discharged together with the dirt particles from the dirt collection region from the dirt particles discharged from the dirt collection region and to return the separated washing liquid back to the water circulation of the dishwasher;

wherein the separator apparatus comprises a collection container that is fluidly connected or connectable to the dirt discharge system, to which, upon emptying of the dirt collection region, the washing liquid with the dirt particles, which is required in order to empty the dirt collection region, is fed from the dirt collection region, wherein a screen system is associated with the collection container, with which screen at least a portion of the washing liquid required for emptying the dirt collection region and discharged from the dirt collection region together with the dirt particles is separated from the dirt particles discharged from the dirt collection region.

14. A dishwasher having at least one washing system configured as a recirculation loop, wherein the at least one washing system comprises a nozzle system having at least one washing nozzle for spraying washing liquid onto items to be cleaned, a washing tank for collecting at least a portion of the sprayed washing liquid, and a washing pump for feeding washing liquid collected in the washing tank to the at least one washing nozzle, and wherein a dirt discharge system associated with the at least one washing system is provided, wherein a tank cover screen is associated with the dirt discharge system, which screen is configured so as to separate dirt particles from the sprayed washing liquid that flows back into the washing tank due to gravity, wherein the dirt discharge system comprises a dirt collection region arranged at least regionally in the washing tank for collecting the dirt particles separated from the washing liquid by the tank cover screen, and wherein the dirt discharge system is fluidly connected to the dirt collection region, via which the dirt collection region can be emptied, wherein the dirt discharge system is associated with a separator apparatus configured so as to separate at least a portion of the washing liquid required to empty the dirt collection region and discharged together with the dirt particles from the dirt collection region from the dirt particles discharged from the dirt collection region and to return the separated washing liquid back to the water circulation of the dishwasher;

wherein the separator apparatus is associated with a waste water pump, which is configured so as to feed the washing liquid separated in the separator apparatus back to the water circulation of the dishwasher at predetermined times and/or events or continuously;

wherein the separator apparatus is associated with a sensor system configured so as to detect the amount of washing liquid separated in the separator apparatus, and wherein the separator apparatus is associated with a control device configured so as to actuate the waste water pump depending on the amount of the washing liquid separated from the dirt particles in the separator apparatus.

15. A dishwasher having at least one washing system configured as a recirculation loop, wherein the at least one washing system comprises a nozzle system having at least one washing nozzle for spraying washing liquid onto items to be cleaned, a washing tank for collecting at least a portion of the sprayed washing liquid, and a washing pump for feeding washing liquid collected in the washing tank to the at least one washing nozzle, and wherein a dirt discharge system associated with the at least one washing system is provided, wherein a tank cover screen is associated with the dirt discharge system, which screen is configured so as to separate dirt particles from the sprayed washing liquid that flows back into the washing tank due to gravity, wherein the dirt discharge system comprises a dirt collection region arranged at least regionally in the washing tank for collecting the dirt particles separated from the washing liquid by the tank cover screen, and wherein the dirt discharge system is fluidly connected to the dirt collection region, via which the dirt collection region can be emptied, wherein the dirt discharge system is associated with a separator apparatus configured so as to separate at least a portion of the washing liquid required to empty the dirt collection region and discharged together with the dirt particles from the dirt collection region from the dirt particles discharged from the dirt collection region and to return the separated washing liquid back to the water circulation of the dishwasher;

wherein:

the dishwasher is configured as a conveyor dishwasher, wherein the at least one washing system is configured as at least one washing zone, and wherein, in addition to the at least one washing system configured as a washing zone, the conveyor dishwasher comprises at least one rinsing zone as well as a conveyor device for conveying the items to be washed through the at least one washing system configured as a washing zone and the at least one rinsing zone that is downstream of the washing system when viewed in the conveying direction of the items to be washed;

or the dishwasher is configured as a program automation and comprises a treatment chamber in which the washing system is configured.

* * * * *